US006269564B1

(12) United States Patent
Ruck

(10) Patent No.: US 6,269,564 B1
(45) Date of Patent: Aug. 7, 2001

(54) PICTURE MOUNTING DEVICE

(76) Inventor: Wolf E. Ruck, 1720 Lincolnshire Blvd., Mississauga, Ontario (CA), L5E 2S7

( * ) Notice: Subject to any disclaimer, the term of this patent is extended or adjusted under 35 U.S.C. 154(b) by 0 days.

(21) Appl. No.: 08/425,196

(22) Filed: Apr. 17, 1995

(30) Foreign Application Priority Data

Jun. 8, 1994 (CA) ..... 2125434

(51) Int. Cl.[7] ..... G09F 1/10
(52) U.S. Cl. ..... 40/124; 40/657
(58) Field of Search ..... 40/124, 124.2, 40/124.4, 618, 657, 775, 776

(56) References Cited

U.S. PATENT DOCUMENTS 382,143 * 5/1888 Curzon ..... 40/618 X
1,024,583 * 4/1912 Kip ..... 40/775
3,529,372 * 9/1970 Kutsch ..... 40/124.2
4,265,040 * 5/1981 Sarkisian ..... 40/618
5,410,830 * 5/1995 Aiken, Sr. ..... 40/471 X

* cited by examiner

*Primary Examiner*—Brian K. Green

(57) ABSTRACT

A picture mounting device (for photographic prints, cards and the like) comprises two or more resiliently flexible transparent strips mounted parallel to each other on a flat surface. The strips have an internal and an external slot configured to easily receive and to clamp the parallel edges of prints to be mounted so that the prints may be inserted and removed quickly and easily from the mounting strips, a minimum of space may be wasted between adjacent prints, the prints are held flat to the surface, the prints remain in full view and the prints are prevented from slipping or falling out, irrespective of the orientation of the base. In one embodiment, the mounting strips are demountably retained in a base so that the distance between parallel strips may be adjusted to accommodate various print sizes and orientations and the clamping tension in the internal and external slots may be adjusted to accommodate prints of various thicknesses.

20 Claims, 4 Drawing Sheets

PICTURE MOUNTING DEVICE

BACKGROUND OF THE INVENTION

This invention relates generally to an improved mounting means for displaying photographic prints, cards and the like, and more particularly to such mounting means having a feature which permits displaying multiple prints in the mount, a feature which facilitates quick and easy insertion, organization and removal of prints in the mount, a feature which facilitates quick and easy insertion, organization and removal of different print sizes and print orientations in the mount, a feature which permits displaying the prints in full view, a feature which minimizes wasted space between prints in the mount and a feature which holds the prints flat and prevents the prints from falling out of the mount, irrespective of the angle at which the mount is held.

Picture mounts generally of the type described herein are known as having means provided for holding prints in position to prevent them from slipping or falling out.

For example, mounting devices having means provided for holding prints behind transparent glass or plastic panes are well known. A matte is used to exert mechanical pressure around the edges of the print, thus holding the print in position. Alternatively, a pane of glass or plastic exerts pressure directly on the surface of the print to hold it in the mount.

Similarly, adhesive corners, tape or backing are used to hold prints in the mount. Laminating is also used to affix prints permanently to a base.

Other mounting devices for displaying prints are known as having means to hold the prints along the edges. In one example, transparent plastic mounting strips are stapled to a base and the bottom edge of the prints is inserted into the slot between the mounting strip and the base.

In another example, the edges of the print are inserted into molded slots attached to a base. The slots are positioned so that the distance between the slots is slightly less than the distance between the print edges. As a consequence, the print must be slightly bowed during insertion into the slots and the resultant tension in the bowed print holds it in place.

While these mounting devices have generally performed satisfactorily, they are not without their shortcomings. For example, a glass pane over the print often causes reflective glare which detracts from the color and detail of the print. In addition, once the prints are mounted behind glass, they are difficult to access, remove, replace or reorganize. Also, since the matting and glass involve relatively heavy and expensive materials, additional costs are incurred to achieve the intended functions.

Similarly, adhesive corners, tape or backing used to fasten prints to a base involve time-consuming application and removal and the adhesive often leaves a sticky residue on the print. Unadhered corners and edges also tend to curl up unless fastened down or held flat behind a glass or plastic pane.

Lamination devices solve many of these drawbacks by affixing the prints permanently to a base, but lamination also eliminates access and the option of removing, replacing or reorganizing prints in the mount. Lamination also requires extra material and heat, thereby increasing costs.

Transparent plastic strips holding the bottom edge of prints allow quick insertion, organization and removal and permit full viewing of the print. However, insertion of the print edge can be difficult when the mounting strips lie flat against the base. Furthermore, a relatively wide mounting strip is required to hold the prints flat, thereby covering a substantial part of the print. The prints can also slide in or fall out of the mount when the base is changed from its normal orientation.

Molded mounting strips with slots for holding the prints along two edges also allow relatively quick insertion, organization and removal of the prints. However, the narrower than-print slot placement required to hold the prints causes the prints to bow slightly, thereby preventing them from lying flat. In addition, the molded mounting strips create a border between the prints, thus wasting space and/or covering the picture edges under the molding.

SUMMARY OF THE INVENTION

It is therefore an object of the present invention to provide an improved mounting device of the type described with a view to simplifying the mounting of photographic prints, cards and the like and reducing the cost of manufacture while at the same time improving upon the efficiency of the mounting operation, increasing the options for organizing the prints, increasing the options for organizing prints of different sizes, thickness or orientation, displaying the full view of each print, holding the prints flat in the mount, reducing the tendency for prints to slide in, or fall out of, the mount when the mount is reoriented from its normal orientation and allowing the prints to be quickly and easily removed from the mount.

Another object is to provide such a mounting device as having means to permit the display of multiple prints while at the same time facilitating quick and easy insertion, organization and removal of multiple prints in the mount.

A further object of this invention is to provide such a mounting device with means to facilitate quick and easy adjustment of said mounting means to accommodate different print sizes, print thicknesses and print orientations.

Another object of this invention is to provide such a mounting device with means to permit displaying the prints in full view.

A further object of this invention is to provide such a mounting device with means to hold the prints flat.

Another object of this invention is to provide such a mounting device with means to minimize wasted space and to maximize the area available for displaying prints.

A further object of this invention is to provide such a mounting device with means to prevent the prints from sliding in or falling out of said mounting means, irrespective of the orientation of the mounting means.

Another object of this invention is to provide such a mounting device with means to allow quick and easy removal of the prints from the mounting device.

Other objects, advantages and novel features of the present invention will become more apparent from the following detailed description of the invention when taken in conjunction with the accompanying drawings.

Accordingly, the present invention comprises a mounting means for photographic prints, cards and the like comprising: (a) two or more mounting strips comprising a fold along the longitudinal axis of said mounting strips, said fold forming a lip, a long leg and a short leg; (b) attachment means between said long leg and any flat surface, said attachment means having a bond with a seam running parallel to the longitudinal axis and along the length of said long leg, said attachment means for fastening said mounting strips to said flat surface; (c) an internal slot bounded by said lip, said long leg and said short leg, said internal slot having an opening between said long leg and said short leg distal to said lip and a proximate portion proximate to said lip and a distal portion distal to said lip, said proximate and distal portions demarcated by said seam along the length of said long leg; whereby, when said mounting strips are attached to any flat surface, an external slot is formed bounded by said seam, said long leg, said lip and said flat surface, said external slot having an opening between said flat surface and said lip distal to said seam; and whereby a plurality of said mounting strips may be fastened parallel to each other on said flat surface with said internal slot openings oriented in the same direction; and whereby said internal slot may have a gap width between said short leg and said long leg sufficient to receive and to lightly clamp the edges of said prints; and whereby said external slot may have a gap width between said flat surface and said long leg sufficient to receive and to firmly clamp the edges of said prints; and whereby said seam between said long leg and said flat surface may form the demarcation between said proximate and said distal portions of said internal slots; and whereby the depth of said proximate portion of said internal slot and the depth of said external slot of said mounting strips may be equal to each other; and whereby the depth of said distal portion of said internal slot may be at least equal to the depth of said external slot; and whereby, when said mounting strips are mounted on said flat surface, the distance between said seams may be equal to the distance between two parallel edges of the print to be mounted so that when the first parallel edge of said print is inserted fully into said proximate portion of said internal slot of a first parallel mounting strip, the second parallel edge of said print may lie parallel to and outside of said external slot opening of a second parallel mounting strip so that said light clamping of said first parallel edge of said print in said internal slot of the first parallel mounting strip may allow said print to be freely moved along said internal slot; and whereby, when said second parallel edge of said print is then pushed fully into said external slot of the second parallel mounting strip to as far as said seam between said flat surface and said long leg, said first parallel edge of said print may remain inside said distal portion of said internal slot of said first mounting strip so that said print may be held flat against said surface; and whereby, when said second parallel edge of said print is then pushed fully into said external slot of the second parallel mounting strip to as far as said seam between said flat surface and said long leg, said first parallel edge of said print may remain inside said distal portion of said internal slot of said first mounting strip and said firm clamping of said second parallel edge of said print in said external slot of the second parallel mounting strip may allow said print to be retained in said external slot and may prevent said print from sliding or falling out, irrespective of the orientation of said mounting means; and whereby, when said second parallel edge of said print is pushed fully into said external slot of the second parallel mounting strip to as far as said seam between said flat surface and said long leg, said first parallel edge of said print may remain parallel to and even with said seam at the demarcation between said proximate and distal portions of said internal slot so that minimum space may be wasted between said first parallel edge of said print in said distal portion of said internal slot of said mounting strip and said second parallel edge of any other print inserted into said external slot of the same mounting strip.

In another aspect, the present invention comprises: (a) a base for mounting and displaying prints, said base having a flat surface; (b) two or more mounting strips comprising: a fold along the longitudinal axis of said mounting strips, said fold forming a lip, a long leg and a short leg; (c) attachment means between said long leg and said flat surface, said attachment means having a bond with a seam running parallel to the longitudinal axis and along the length of said long leg, said attachment means for fastening said mounting strips to said flat surface; (d) an internal slot bounded by said lip, said long leg and said short leg, said internal slot having an opening between said long leg and said short leg distal to said lip and a proximate portion proximate to said lip and a distal portion distal to said lip, said proximate and distal portions demarcated by said seam along the length of said long leg; (e) an external slot bounded by said seam, said flat surface, said long leg and said lip, said external slot having an opening between said flat surface and said lip distal to said seam; whereby a plurality of said mounting strips may be fastened parallel to each other on said flat surface with said internal slot openings oriented in the same direction; and whereby said internal slot may have a gap width between said short leg and said long leg sufficient to receive and to lightly clamp the edges of said prints; and whereby said external slot may have a gap width between said flat surface and said long leg sufficient to receive and to firmly clamp the edges of said prints; and whereby said seam between said long leg and said flat surface may form the demarcation between said proximate and said distal portions of said internal slots; and whereby the depth of said proximate portion of said internal slot and the depth of said external slot of said mounting strips may be equal to each other; and whereby the depth of said distal portion of said internal slot may be at least equal to the depth of said external slot; and whereby, when said mounting strips are mounted on said flat surface, the distance between said seams may be equal to the distance between two parallel edges of the print to be mounted so that when the first parallel edge of said print is inserted fully into said proximate portion of said internal slot of a first parallel mounting strip, the second parallel edge of said print may lie parallel to and outside of said external slot opening of a second parallel mounting strip so that said light clamping of said first parallel edge of said print in said internal slot of the first parallel mounting strip may allow said print to be freely moved along said internal slot; and whereby, when said second parallel edge of said print is then pushed fully into said external slot of the second parallel mounting strip to as far as said seam between said flat surface and said long leg, said first parallel edge of said print may remain inside said distal portion of said internal slot of said first mounting strip so that said print may be held flat against said surface; and whereby, when said second parallel edge of said print is then pushed fully into said external slot of the second parallel mounting strip to as far as said seam between said flat surface and said long leg, said first parallel edge of said print may remain inside said distal portion of said internal slot of said first mounting strip and said firm clamping of said second parallel edge of said print in said external slot of the second parallel mounting strip may allow said print to be retained in said external slot and may prevent said print from sliding or falling out, irrespective of the orientation of said mounting means; and whereby, when said second parallel edge of said print is pushed fully into said external slot of the second parallel mounting strip to as far as said seam between said flat surface and said long leg, said first parallel edge of said print may remain parallel to and even with said seam at the demarcation between said proximate and distal portions of said internal slot so that minimum space may be wasted between said first parallel edge of said print in said distal portion of said internal slot of said mounting strip and said second parallel edge of any other print inserted into said external slot of the same mounting strip.

In another aspect, the present invention comprises: (a) a base for mounting and displaying prints, said base having a flat surface; (b) multiple slots in said base, said slots oriented transverse to said flat surface and having floor and ceiling surfaces; (c) one or more serrations in said floor and/or ceiling surfaces, said serrations having a distal surface oriented transverse to said floor and ceiling surfaces and a proximate surface oriented at a slope to said floor and ceiling surfaces; (d) two or more mounting strips comprising: a fold along the longitudinal axis of said mounting strips, said fold forming a lip, a long leg and a short leg; an arm extending from said long leg on the side of said long leg opposite said short leg, said arm oriented transverse to said long leg and dividing said long leg into a proximate arm and a distal arm, said transverse arm for insertion into said transverse slots in said base; one or more fingers extending on one or both sides along the longitudinal axis of said transverse arm of said mounting strips, said finger or fingers oriented transverse to said transverse arm for retainingly engaging said serrations in said floor and/or ceiling of said transverse slots; (e) an internal slot bounded by said lip, said long leg and said short leg, said internal slot having an opening between said distal arm of said long leg and said short leg distal to said lip and a proximate portion between said short leg and said proximate arm of said long leg proximate to said lip and a distal portion between said short leg and said distal arm of said long leg distal to said lip, said proximate and distal portions demarcated by said transverse arm along the length of said long leg; (f) an external slot bounded by said transverse arm, said flat surface, said proximate arm of said long leg and said lip, said external slot having an opening between said flat surface and said lip distal to said transverse arm; whereby a plurality of said transverse slots may be oriented parallel to each other on said flat surface in said base; and whereby the distance between various said parallel transverse slots may be equal to the distance between parallel edges of various prints to be mounted; and whereby said floor and ceiling surfaces in said transverse slots may run parallel to each other along the length of said transverse slots; and whereby said serrations may run parallel to each other along the length of said floor and/or ceiling surfaces; and whereby said parallel floor and ceiling surfaces in said transverse slots may have a gap width between them for receiving said transverse arm with said transverse finger or fingers; and whereby the width of said transverse arm may be sufficient to allow said transverse arm to be inserted into and retained in said transverse slots in said base; and whereby the width of said finger or fingers may be sufficient to allow said finger or fingers to retainingly engage said serrations; and whereby the angle between said transverse arm and said finger or fingers may be gradually decreased as said transverse arm is inserted into said transverse slots and as said finger or fingers pass over said proximate surfaces of said serrations, thereby storing elastic tension in said finger or fingers so that said stored elastic tension may have the effect of restoring said angle to its original size against said static floor and/or ceiling of said transverse slots of said base, thereby reciprocally engaging said finger or fingers with said distal surfaces of said serrations so that said transverse arm may be retained in said transverse slots and said mounting strips may be fastened to said base; and whereby the angle between said transverse arm and said finger or fingers may be gradually increased as said transverse arm is retracted from said transverse slots and as said finger or fingers pass over said distal surfaces of said serrations, thereby storing elastic tension in said finger or fingers so that said stored elastic tension may restore said angle to its original size when said finger or fingers pass over said proximate surfaces and out of said transverse slots, thereby reciprocally disengaging said finger or fingers from said distal surfaces of said serrations so that said transverse arm may be retracted from said transverse slots and said mounting strips may be remountably released from said base; and whereby a plurality of said mounting strips may be fastened parallel to each other on said flat surface by inserting said transverse arm of said mounting strips into said parallel transverse slots in said base with said internal slot openings oriented in the same direction; and whereby said internal slot may have a gap width between said short leg and said long leg sufficient to receive and to lightly clamp the edges of said prints; and whereby said external slot may have a gap width between said proximate arm of said long leg and said flat surface sufficient to receive and to firmly clamp the edges of said prints; and whereby said finger or fingers may reciprocally engage more or less distal serrations of said transverse slots as said transverse arm is inserted more or less deeply into said transverse slots of said base so that said transverse arm may be adjustably retained in said transverse slots so that said external gap width between said flat surface of said base and said proximate arm of said long leg may be correspondingly adjusted to receive and firmly clamp said prints of various thicknesses; and whereby said transverse arm of said mounting strips may form the demarcation between said proximate and said distal portions of said internal slot; and whereby the depth of said proximate portion of said internal slot and the depth of said external slot of said mounting strips may be equal to each other; and whereby the depth of said distal portion of said internal slot may be at least equal to the depth of said external slot; and whereby, when said mounting strips are mounted on said flat surface, the distance between said transverse arms of said mounting strips may be equal to the distance between two parallel edges of the print to be mounted so that when the first parallel edge of said print is inserted fully into said proximate portion of said internal slot of a first parallel mounting strip, the second parallel edge of said print may lie parallel to and outside of said external slot opening of a second parallel mounting strip so that said light clamping of said first parallel edge of said print in said internal slot of the first parallel mounting strip may allow said print to be freely moved along said internal slot; and whereby, when said second parallel edge of said print is then pushed fully into said external slot of the second parallel mounting strip to as far as said transverse arm, said first parallel edge of said print may remain inside said distal portion of said internal slot of said first mounting strip so that said print may be held flat against said surface; and whereby, when said second parallel edge of said print is then pushed fully into said external slot of the second parallel mounting strip to as far as said transverse arm, said first parallel edge of said print may remain inside said distal portion of said internal slot of said first mounting strip and said firm clamping of said second parallel edge of said print in said external slot of the second parallel mounting strip may allow said print to be retained in said external slot and may prevent said print from sliding or falling out, irrespective of the orientation of said mounting means; and whereby, when said second parallel edge of said print is pushed fully into said external slot of the second parallel mounting strip to as far as said transverse arm, said first parallel edge of said print may remain parallel to and even with said transverse arm at the demarcation between said proximate and distal portions of said internal slot so that minimum space may be wasted between said first parallel edge of said print in said distal portion of said internal slot of said mounting strip and said second parallel edge of any other print inserted into said external slot of the same mounting strip; and whereby, when said first and second mounting strips are demounted and remounted in different said parallel slots, the distance between respective said parallel mounting strips may be adjustably increased or decreased to receive and to clamp said first and second parallel edges of prints of various sizes.

In another aspect, the present invention comprises: (a) a base for mounting and displaying prints, said base having a flat surface; (b) multiple slots in said base, said slots oriented transverse to said flat surface and having floor and ceiling surfaces; (c) one or more serrations in said floor and/or ceiling surfaces, said serrations having a distal surface oriented transverse to said floor and ceiling surfaces and a proximate surface oriented at a slope to said floor and ceiling surfaces; (d) two or more mounting strips comprising: a fold along the longitudinal axis of said mounting strips, said fold forming a lip, a long leg and a short leg; an arm extending from the distal end of said short leg on the side of said short leg opposite said long leg, said arm oriented transverse to said short leg, said transverse arm for insertion into said transverse slots in said base; a shoulder formed at the junction of said transverse leg and said short arm; one or more fingers extending on one or both sides along the longitudinal axis of said transverse arm of said mounting strips, said finger or fingers oriented transverse to said transverse arm for retainingly engaging said serrations in said floor and/or ceiling of said transverse slots; (e) an internal slot bounded by said lip, said long leg and said short leg, said internal slot having an opening between said flat surface and said long leg distal to said lip and a proximate portion between said long leg and said short leg proximate to said lip and a distal portion between said long leg and said flat surface distal to said lip, said proximate and distal portions demarcated by said transverse arm along the length of said short leg; (f) an external slot bounded by said transverse arm, said flat surface, said short leg and said lip, said external slot having an opening between said flat surface and said lip distal to said transverse arm; whereby a plurality of said transverse slots may be oriented parallel to each other on said flat surface in said base; and whereby the distance between various said parallel transverse slots may be equal to the distance between parallel edges of various prints to be mounted; and whereby said floor and ceiling surfaces in said transverse slots may run parallel to each other along the length of said transverse slots; and whereby said serrations may run parallel to each other along the length of said floor and/or ceiling surfaces; and whereby said parallel floor and ceiling surfaces in said transverse slots may have a gap width between them for receiving said transverse arm with said transverse finger or fingers; and whereby the width of said transverse arm may be sufficient to allow said transverse arm to be inserted into and retained in said transverse slots in said base; and whereby the width of said finger or fingers may be sufficient to allow said finger or fingers to retainingly engage said serrations; and whereby the angle between said transverse arm and said finger or fingers may be gradually decreased as said transverse arm is inserted into said transverse slots and as said finger or fingers pass over said proximate surfaces of said serrations, thereby storing elastic tension in said finger or fingers so that said stored elastic tension may have the effect of restoring said angle to its original size against said static floor and/or ceiling of said transverse slots of said base, thereby reciprocally engaging said finger or fingers with said distal surfaces of said serrations so that said transverse arm may be retained in said transverse slots and said mounting strips may be fastened to said base; and whereby the angle between said transverse arm and said finger or fingers may be gradually increased as said transverse arm is retracted from said transverse slots and as said finger or fingers pass over said distal surfaces of said serrations, thereby storing elastic tension in said finger or fingers so that said stored elastic tension may restore said angle to its original size when said finger or fingers pass over said proximate surfaces and out of said transverse slots, thereby reciprocally disengaging said finger or fingers from said distal surfaces of said serrations so that said transverse arm may be retracted from said transverse slots and said mounting strips may be remountably released from said base; and whereby a plurality of said mounting strips may be fastened parallel to each other on said flat surface by inserting said transverse arm of said mounting strips into said parallel transverse slots in said base with said internal slot openings oriented in the same direction; and whereby said internal slot may have a gap width between said long leg and said short leg sufficient to receive and to lightly clamp the edges of said prints; and whereby said external slot may have a gap width between said short leg and said flat surface sufficient to receive and to firmly clamp the edges of said prints; and whereby said finger or fingers may reciprocally engage more or less distal serrations of said transverse slots as said transverse arm is inserted more or less deeply into said transverse slots of said base so that said transverse arm may be adjustably retained in said transverse slots so that said external gap width between said flat surface of said base and said short leg of said mounting strips may be correspondingly adjusted to receive and firmly clamp said prints of various thicknesses; and whereby said transverse arm of said mounting strip may form the demarcation between said proximate and said distal portions of said internal slot; and whereby the depth of said proximate portion of said internal slot and the depth of said external slot of said mounting strips may be equal to each other; and whereby the depth of said distal portion of said internal slot may be at least equal to the depth of said external slot; and whereby, when said mounting strips are mounted on said flat surface, the distance between said transverse arms of said mounting strips may be equal to the distance between two parallel edges of the print to be mounted so that when the first parallel edge of said print is inserted fully into said proximate portion of said internal slot of a first parallel mounting strip, the second parallel edge of said print may lie parallel to and outside of said external slot opening of a second parallel mounting strip so that said light clamping of said first parallel edge of said print in said internal slot of the first parallel mounting strip may allow said print to be freely moved along said internal slot; and whereby, when said second parallel edge of said print is then pushed fully into said external slot of the second parallel mounting strip to as far as said transverse arm, said first parallel edge of said print may remain inside said distal portion of said internal slot of said first mounting strip so that said print may be held flat against said surface; and whereby, when said second parallel edge of said print is then pushed fully into said external slot of the second parallel mounting strip to as far as said transverse arm, said first parallel edge of said print may remain inside said distal portion of said internal slot of said first mounting strip and said firm clamping of said second parallel edge of said print in said external slot of the second parallel mounting strip may allow said print to be retained in said external slot and may prevent said print from sliding or falling out, irrespective of the orientation of said mounting means; and whereby, when said second parallel edge of said print is pushed fully into said external slot of the second parallel mounting strip to as far as said transverse arm, said first parallel edge of said print may remain parallel to and even with said transverse arm at the demarcation between said proximate and distal portions of said internal slot so that minimum space may be wasted between said first parallel edge of said print in said distal portion of said internal slot of said mounting strip and said second parallel edge of any other print inserted into said external slot of the same mounting strip; and whereby, when said first and second mounting strips are demounted and remounted in different said parallel slots, the distance between respective said parallel mounting strips may be adjustably increased or decreased to receive and to clamp said first and second parallel edges of prints of various sizes.

BRIEF DESCRIPTION OF THE DRAWINGS

In the figures which describe example embodiments of the invention.

DESCRIPTION OF THE PREFERRED EMBODIMENTS

Figure 1:
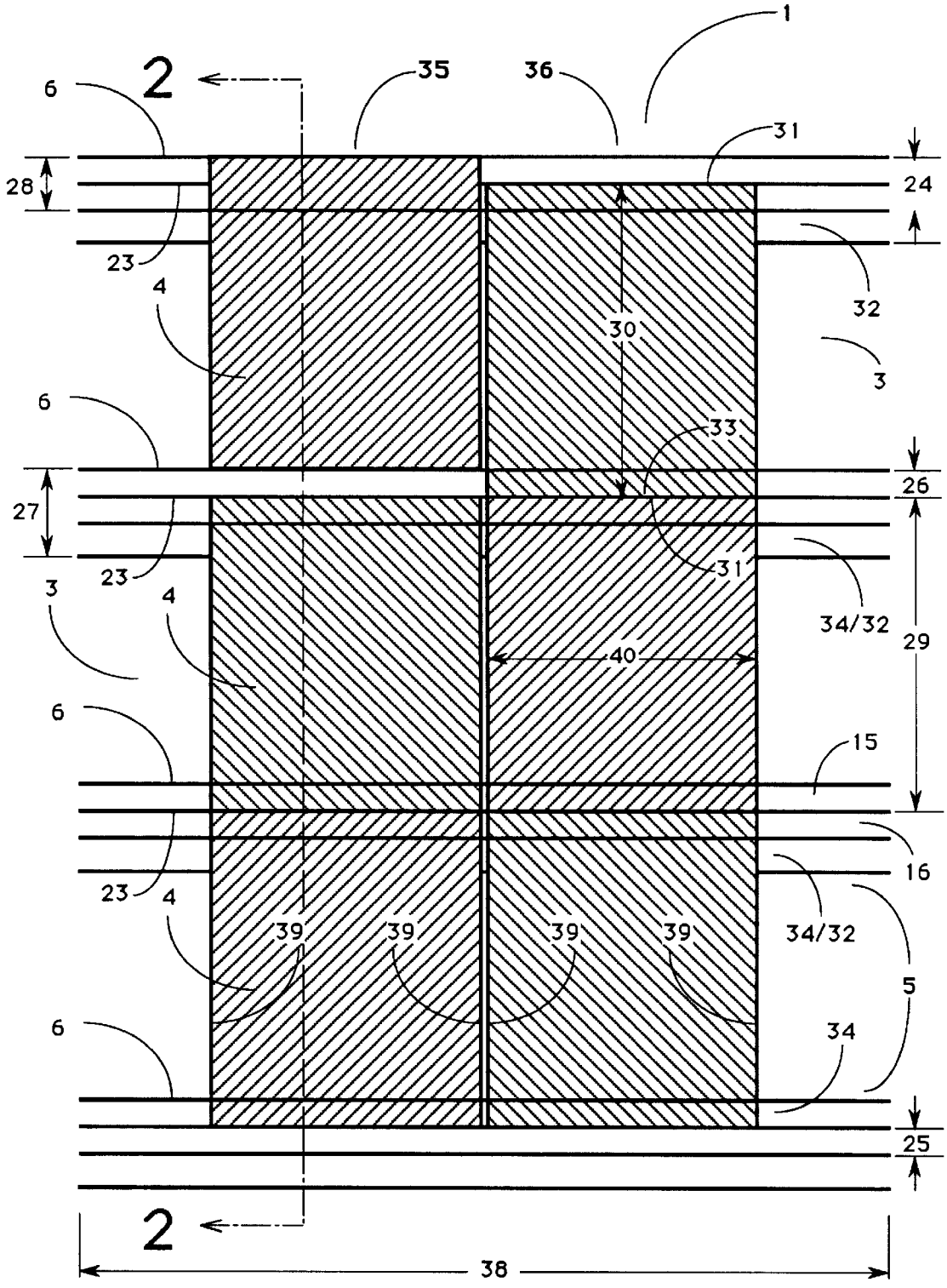
FIG. 1 is a front view of a mounting device made in accordance with this invention showing multiple prints mounted in an organizing mode and a display mode.
Figure 2:
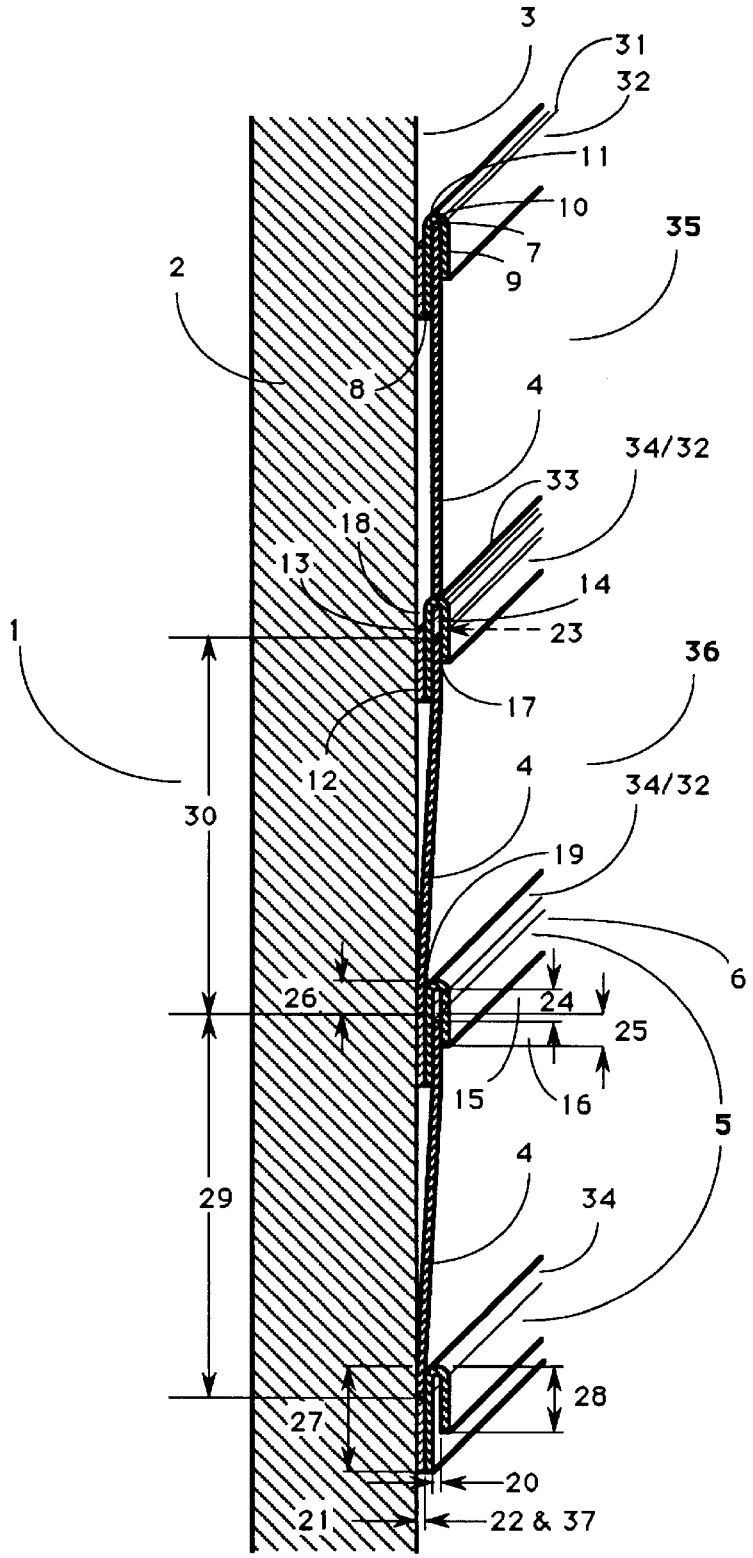
FIG. 2 is a fragmentary vertical sectional side view of a mounting device made in accordance with this invention showing multiple prints mounted in an organizing mode and a display mode.

Referring to FIGS. 1 and 2, a picture mounting device indicated generally at 1 includes a base 2 with a flat surface 3 suitable for mounting photographic prints, cards and the like 4, and a mounting means indicated generally at 5.

Mounting means 5 comprises two or more resiliently flexible transparent plastic and the like mounting strips 6 mounted in parallel to each other on flat surface 3 by means of a permanent or semi-permanent bond 12 along seam 13.

Mounting strips 6 have a fold 7 forming a long leg 8, a short leg 9 and a lip 10 with a convex surface 11. Long leg 8, short leg 9 and lip 10 form internal slot 14 with internal slot opening 17.

Long leg 8 is attached to bond 12 to form external slot 18 bounded by seam 13, flat surface 3, long leg 8 and lip 10. External slot opening 19 is formed between flat surface 3 and convex lip surface 11.

Seam 13 is positioned parallel to and even with the demarcation line 23 of short leg 9 so that the depth 26 above seam 13 of external slot 18, the depth 24 of the proximate portion 15 of internal slot 14 above seam 13, and the depth 25 of the distal portion 16 of internal slot 14 below seam 13 are equal to each other.

Length 38 of parallel mounting strips 6 is equal to the total distance 40 between parallel edges 39 of one or more prints 4 so that parallel edges 39 lie immediately adjacent to each other when prints 4 are mounted in parallel mounting strips 6 so that minimum space is wasted between adjacent parallel edges 39 of prints 4.

First parallel mounting strip 32 is arrayed in parallel to second parallel mounting strip 34 on flat surface 3 so that the distance 29 between parallel seams 13 is equal to the distance between parallel print edges 31 and 33.

Resiliently flexible fold 7 is adjusted so that gap width 20 of internal slot 14 is sufficient to receive and lightly clamp first parallel print edge 31 with print thickness 37, and seam thickness 22 together with resiliently flexible long leg 8 is adjusted so that gap width 21 of external slot 18 is sufficient to receive and firmly clamp second parallel print edge 33 with print thickness 37.

In the organizing mode of operation indicated generally at 35, first parallel mounting strips 32 are arrayed in parallel to second parallel mounting strips 34 on flat surface 3 so that internal slots 14 open in the same direction and so that the distance 29 between seams 13 is equal to the distance 30 between parallel print edges 31 and 33.

First parallel print edge 31 is then slid along long leg 8, inserted into internal slot opening 17 and pushed through distal portion 16 fully into proximate portion 15 of internal slot 14 of first parallel mounting strip 32.

With the distance 29 between seams 13 of parallel mounting strips 32 and 34 equal to the distance 30 between parallel print edges 31 and 33, and with the depth 24 of proximate portion 15 of internal slot 14. equal to the depth 26 of external slot 18, second parallel print edge 33 lies parallel to and immediately outside opening 19 of external slot 18 of second parallel mounting strip 34.

With gap width 20 of internal slot 14 sufficient to receive and lightly clamp first parallel print edge 31 with print thickness 37, and with second parallel print edge 33 lying outside opening 19 of external slot 18, prints 4 are easily and quickly inserted into, retained in, slid along or removed from internal slot 14 so that efficient organizing of multiple prints in mounting device 1 is facilitated.

In the displaying mode of operation indicated generally at 36, second parallel print edge 33 is deflected by convex lip surface 11 into external slot opening 19 as it is pushed and inserted fully into external slot 18 of second parallel mounting strip 34. With the distance 29 between seams 13 of parallel mounting strips 32 and 34 equal to the distance 30 between parallel print edges 31 and 33, and with the depth 24 of proximate portion 15 of internal slot 14 equal to the depth 26 of external slot 18, first parallel print edge 31 lies parallel to and even with seam 13 of first parallel mounting strip 32 so that when a second parallel edge 33 of any other print 4 is inserted into external slot 18 of first parallel mounting strip 32, minimum space is wasted between the first parallel print edge 31 of print 4 and the second parallel print edge 33 of any other print 4 inserted into external slot 18 of first parallel mounting strip 32 and the prints remain in full view.

With the distance 29 between seams 13 of parallel mounting strips 32 and 34 equal to the distance 30 between parallel print edges 31 and 33, and with the depth 25 of distal portion 16 of internal slot 14 at least equal to the depth 26 of external slot 18, first parallel print edge 31 lies parallel to and even with demarcation line 23 of short leg 9 of first parallel mounting strip 32 so that first parallel print edge 31 is lightly clamped in distal portion 16 of internal slot 14 so that print 4 is held flat against flat surface 3 in internal slot 14 for optimum display of prints in displaying mode 36.

With gap width 21 of external slot 18 sufficient to receive and firmly clamp second parallel print edge 33 with print thickness 37, print 4 is prevented from sliding in or falling out of said mounting means 5, irrespective of the orientation of mounting device 1.

Figure 3:
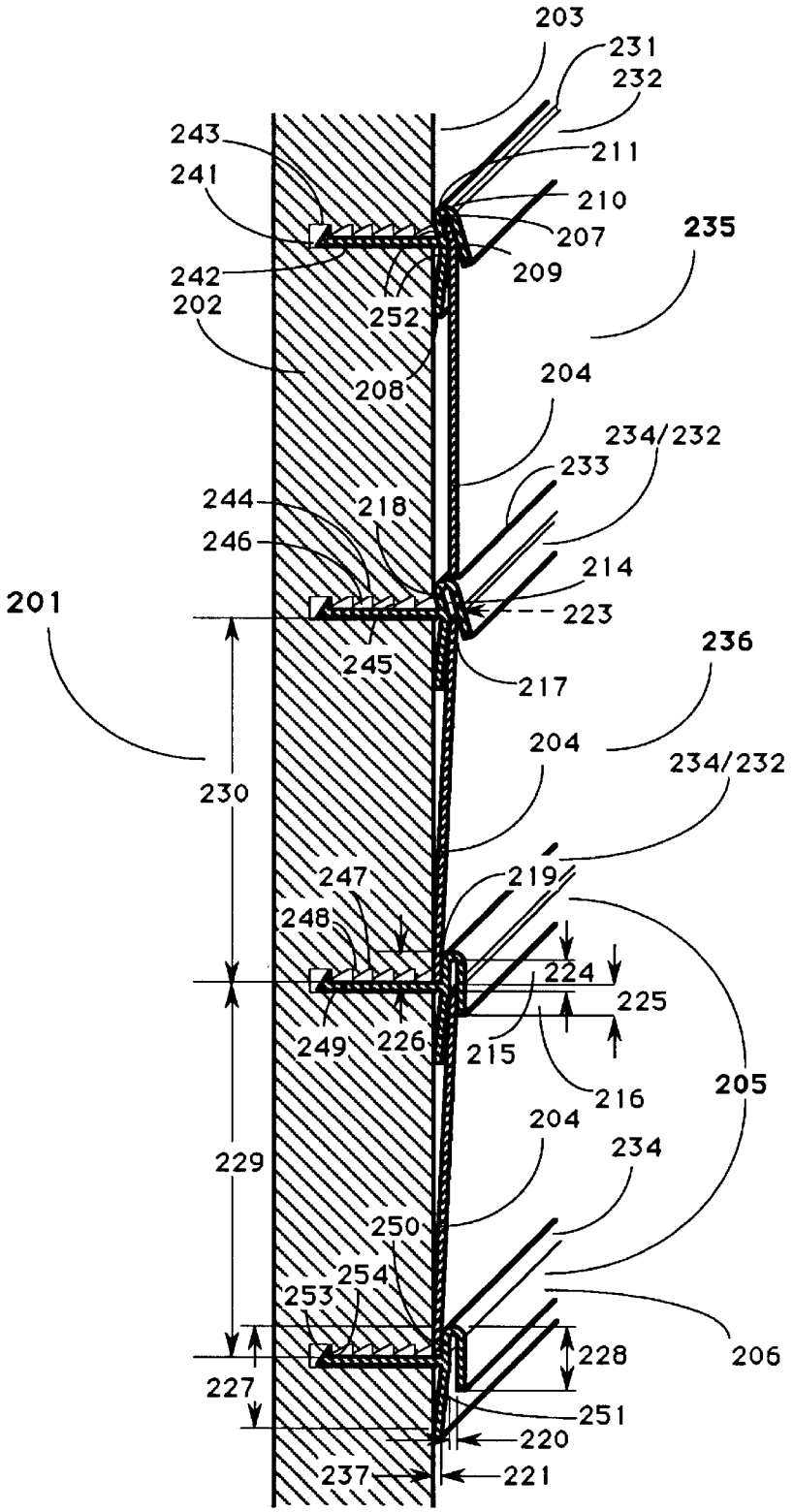
FIG. 3 is a fragmentary vertical sectional side view of another embodiment of a mounting device made in accordance with this invention.

In the embodiment of FIG. 3, a picture mounting device indicated generally at 201 includes a base 202 with a flat surface 203 suitable for mounting photographic prints, cards and the like 204, and mounting means indicated generally at 205.

Base 202 has parallel transverse slots 241 comprising floor 242 and ceiling 243 having one or more serrations 244 with distal surface 245 at acute-to-right angle 248 transverse to, and proximate surface 246 at acute angle 247 sloped to, floor and/or ceiling 242 and 243 respectively.

Mounting means 205 comprises two or more resiliently flexible transparent plastic and the like mounting strips 206 mounted in parallel to each other on flat surface 203.

Mounting strips 206 have a fold 207 forming a long leg 208, a short leg 209 and a lip 210 with a convex surface 211.

Transverse arm 249 extends from long leg 208 on the side of long leg 208 opposite short leg 209 for insertion into transverse slots 241 in base 202. Transverse arm 249 has a finger 253 with acute-to-right angle 254 on one or both sides of transverse arm 249 for reciprocally engaging serrations 244 in floor 242 and/or ceiling 243 of transverse slots 241.

Transverse arm 249 forms proximate arm 250 and distal arm 251 at acute angle 252 to long leg 208 for extending along flat surface 203 of base 202.

Acute-to-right angle 254 of finger 253 is gradually decreased as finger 253 passes over acute-angled proximate surfaces 246 of serrations 244 during insertion of transverse arm 249 into transverse slots 241 so that elastic tension is stored in angle 254. This elastic tension has the effect of restoring angle 254 to its original size against static floor and/or ceiling 242 and 243 of transverse slots 241 in base 202 so that fingers 253 engage distal surfaces 245 of serrations 244 with the result that transverse arm 249 is retained in transverse slots 241 so that mounting strips 206 are mounted on base 202.

Conversely, acute-to-right angle 254 of finger 253 gradually increases as finger 253 passes over distal surfaces 245 of serrations 244 during retraction of transverse arm 249 from transverse slots 241 and elastic tension is stored in finger 253 which restores angle 254 to original size when finger 253 passes over acute-angled proximate surfaces 246 of transverse slot 241 so that finger 253 is reciprocally disengaged from distal surfaces 245 of serrations 244 with the result that transverse arm 249 is retracted from transverse slots 241 so that mounting strips 206 are remountably dismounted from base 202.

Also, transverse arm 249 of long leg 208 is inserted more or less deeply into transverse slots 241 of base 202 so that finger 253 reciprocally engages more or less distal serrations 244 in floor and/or ceiling 242 and 243 with the result that acute angle 252 between transverse arm 249 with proximate arm 250 and distal arm 251 is increased or decreased, thereby storing more or less elastic tension in angle 252 with the result that flat surface 203 and distal surface 245 of base 202 are reciprocally clamped more or less firmly between proximate arm 250 and finger 253 and distal arm 251 and finger 253 so that mounting strips 206 are firmly retained in transverse slots 241.

Long leg 208, short leg 209 and lip 210 form internal slot 214 with internal slot opening 217. Transverse arm 249 is inserted into transverse slots 241 to form external slot 218 bounded by transverse arm 249, flat surface 203, short leg 209 and convex lip surface 211.

Transverse arm 249 is positioned parallel to and even with demarcation line 223 of long leg 208 so that the depth 226 of external slot 218 above transverse arm 249 equals the depth 224 of proximate portion 215 of internal slot 214 above transverse arm 249, and the depth 225 of distal portion 216 of internal slot 214 below transverse arm 249 is at least equal to the depth 226 of external slot 218.

First parallel mounting strip 232 is arrayed in parallel to second parallel mounting strip 234 on flat surface 203 so that the distance 229 between transverse arms 249 is equal to the distance 230 between parallel print edges 231 and 233.

Resiliently flexible fold 207 is adjusted so that gap width 220 of internal slot 214 is sufficient to receive and lightly clamp first parallel print edge 231 with print thickness 237, and acute angle 252 between proximate arm 250 and transverse arm 249 of resiliently flexible long leg 208 is adjusted so that gap width 221 of external slot 218 is sufficient to receive and firmly clamp second parallel print edge 233 with print thickness 237.

In addition, transverse arm 249 is inserted more or less deeply into transverse slots 241 of base 202 so that finger 253 reciprocally engages more or less distal serrations 244 in floor 242 and/or ceiling 243 of transverse slots 241 with the result that acute angles 254 and 252 are increased or decreased, thereby storing more or less elastic tension in angles 254 and 252 with the result that proximate arm 250 of long leg 208 is pressed more or less strongly against flat surface 203 so that gap width 221 of external slot 218 is sufficient to receive and firmly clamp second parallel print edge 233 with print thickness 237.

In the organizing mode of operation indicated generally at 235, first parallel mounting strips 232 are arrayed in parallel to second parallel mounting strips 234 on flat surface 203 by inserting transverse arms 249 into parallel transverse slots 241 so that internal slots 214 open in the same direction and so that the distance 229 between transverse arms 249 is equal to the distance 230 between parallel print edges 231 and 233.

First parallel print edge 231 is then slid along distal arm 251, inserted into internal slot opening 217 and pushed through distal portion 216 over the smooth junction of transverse arm 249 with long leg 208 and fully into proximate portion 215 of internal slot 214 of first parallel mounting strip 232.

With the distance 229 between transverse arms 249 of parallel mounting strips 232 and 234 equal to the distance 230 between parallel print edges 231 and 233, and with the depth 224 of proximate portion 215 of internal slot 214 equal to the depth 226 of external slot 218, second parallel print edge 233 lies parallel to and immediately outside opening 219 of external slot 218 of second parallel mounting strip 234.

With gap width 220 of internal slot 214 sufficient to receive and lightly clamp first parallel print edge 231 with print thickness 237, and with second parallel print edge 233 lying outside opening 219 of external slot 218, prints 204 are easily and quickly inserted into, retained in, slid along or removed from internal slot 214 so that efficient organizing of multiple prints in mounting device 201 is facilitated.

In the displaying mode of operation indicated generally at 236, second parallel print edge 233 is inserted fully into external slot 218 of second parallel mounting strip 234. With the distance 229 between transverse arms 249 of parallel mounting strips 232 and 234 equal to the distance 230 between parallel print edges 231 and 233, and with the depth 224 of proximate portion 215 of internal slot 214 equal to the depth 226 of external slot 218, first parallel print edge 231 lies parallel to and even with transverse arm 249 of first parallel mounting strip 232 so that when a second parallel edge 233 of any other print 204 is inserted into external slot 218 of first parallel mounting strip 232, minimum space is wasted between the first parallel print edge 231 of print 204 and the second parallel print edge 233 of any other print 204 inserted into external slot 218 of first parallel mounting strip 232 and the prints remain in full view.

With the distance 229 between transverse arms 249 of parallel mounting strips 232 and 234 equal to the distance 230 between parallel print edges 231 and 233, and with the depth 225 of distal portion 216 of internal slot 214 at least equal to the depth 226 of external slot 218, first parallel print edge 231 lies parallel to and even with demarcation line 223 of short leg 209 of first parallel mounting strip 232 so that first parallel print edge 231 is lightly clamped in distal portion 216 of internal slot 214 so that print 204 is held flat against flat surface 203 in internal slot 214 for optimum display of prints in the displaying mode.

With gap width 221 of external slot 218 sufficient to receive and firmly clamp second parallel print edge 233 with print thickness 237, print 204 is prevented from sliding in or falling out of said mounting means 205, irrespective of the orientation of mounting device 201.

Figure 4:
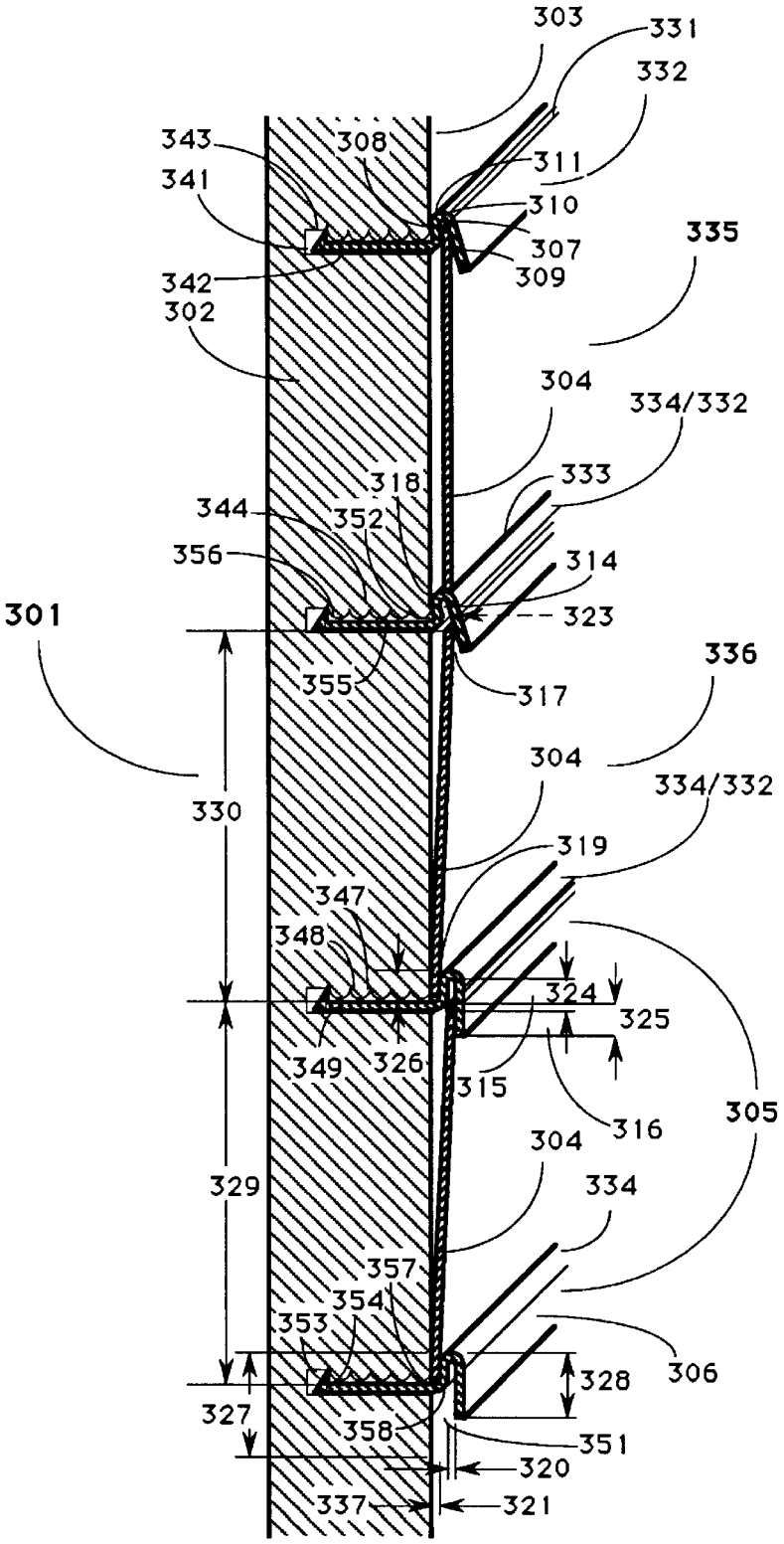
FIG. 4 is a fragmentary vertical sectional side view of another embodiment of a mounting device made in accordance with this invention.

In the embodiment of FIG. 4, a picture mounting device indicated generally at 301 includes a base 302 with a flat surface 303 suitable for mounting photographic prints, cards and the like 304, and mounting means indicated generally at 305.

Base 302 has parallel transverse slots 341 comprising floor 342 and ceiling 343 having one or more serrations 344 with proximate convex surface 355 proximate to flat surface 303 and distal convex surface 356 distal to flat surface 303. Proximate convex surface 355 gradually slopes from a plane at a right angle to floor 342 and/or ceiling 343 to a plane parallel to floor 342 and/or ceiling 343 and distal convex surface 356 gradually slopes from a plane parallel to floor 342 and/or ceiling 343 to a plane at a right angle to floor 342 and/or ceiling 343.

Mounting means 305 comprises two or more resiliently flexible transparent plastic and the like mounting strips 306 mounted in parallel to each other on flat surface 303.

Mounting strips 306 have a fold 307 forming a long leg 309, a short leg 308 and a lip 310 with a convex surface 311. Long leg 309, short leg 308 and lip 310 form internal slot 314 with internal slot opening 317.

Transverse arm 349 extends from short leg 308 on the side of short leg 308 opposite long leg 309 for insertion into transverse slots 341 in base 302. The junction of short leg 308 and transverse arm 349 forms a shoulder 357 with a convex surface 358 facing long leg 309.

Transverse arm 349 has a finger 353 with acute-to-right angle 354 on one or both sides of transverse arm 349 for reciprocally engaging serrations 344 in floor 342 and/or ceiling 343 of transverse slots 341.

Transverse arm 349 forms an acute angle 352 with short leg 308 extending along flat surface 303 of base 302.

Acute-to-right angle 354 of finger 353 is gradually decreased as finger 353 passes over proximate convex surface 355 of serrations 344 during insertion of transverse arm 349 into transverse slots 341 so that elastic tension is stored in acute angle 354. This elastic tension has the effect of restoring angle 354 to its original size against static floor 342 and/or ceiling 343 of transverse slots 341 in base 302 so that finger 353 engages distal convex surface 356 of serrations 344 with the result that transverse arm 349 is retained in transverse slots 341 so that mounting strips 306 are mounted on base 302.

Conversely, acute-to-right angle 354 of finger 353 gradually increases as finger 353 passes over distal convex surface 356 of serrations 344 during retraction of transverse arm 349 from transverse slots 341 and elastic tension is stored in finger 353 which restores angle 354 to original size when finger 353 passes over proximate convex surface 355 of transverse slots 341 so that finger 353 is reciprocally disengaged from distal convex surface 356 of serrations 344 with the result that transverse arm 349 is retracted from transverse slots 341 so that mounting strips 306 are remountably dismounted from base 302.

Also, transverse arm 349 of short leg 308 is inserted more or less deeply into transverse slots 341 of base 302 so that finger 353 reciprocally engages more or less distal serrations 344 in floor and/or ceiling 342 and 343 with the result that acute angle 352 between transverse arm 349 and short leg 308 is increased or decreased, thereby storing more or less elastic tension in angle 352 with the result that flat surface 303 and distal convex surface 356 of base 302 are reciprocally clamped more or less firmly between short leg 308 and finger 353 so that mounting strips 306 are firmly retained in transverse slots 341.

Transverse arm 349 is inserted into transverse slots 341 to form external slot 318 bounded by transverse arm 349, flat surface 303, short leg 308 and convex lip surface 311.

Transverse arm 349 is positioned parallel to and even with demarcation line 323 of long leg 309 so that depth 326 of external slot 318 above transverse arm 349 equals depth 324 of the proximate portion 315 of internal slot 314 above transverse arm 349 and depth 325 of the distal portion 316 of internal slot 314 below transverse arm 349 is at least equal to depth equal to depth 326 of external slot 318.

First parallel mounting strip 332 is arrayed in parallel to second parallel mounting strip 334 on flat surface 303 so that the distance 329 between transverse arms 349 is equal to the distance 330 between parallel print edges 831 and 333.

Resiliently flexible fold 307 is adjusted so that gap width 320 of internal slot 314 is sufficient to receive and lightly clamp first parallel print edge 331 with print thickness 337. Also, resiliently flexible shoulder 357 is adjusted so that surface 358 is more or less convex so that first parallel print edge 331 is more or less lightly clamped between convex surface 358 and long leg 309.

Acute angle 352 between short leg 308 and transverse arm 349 of resiliently flexible mounting strips 306 is adjusted so that gap width 321 of external slot 318 is sufficient to receive and firmly clamp second parallel print edge 333 with print thickness 337.

In addition, transverse arm 849 is inserted more or less deeply into transverse slots 341 of base 302 so that finger 353 reciprocally engages more or less distal serrations 344 in floor 342 and/or ceiling 343 of transverse slots 341 with the result that acute angles 354 and 352 are respectively increased or decreased, thereby storing more or less elastic tension in angles 354 and 352 with the result that short leg 308 is pressed more or less strongly against flat surface 303 so that gap width 321 of external slot 318 is sufficient to receive and firmly clamp second parallel print edge 333 with print thickness 337.

Correspondingly, as transverse arm 349 is inserted more or less deeply into transverse slots 341 of base 302 so that finger 353 reciprocally engages more or less distal serrations 844 in floor 342 and/or ceiling 343 of transverse slots 341 with the result that acute angle 352 is respectively increased or decreased, thereby storing more or less elastic tension in angle 352 with the result that short leg 308 is pressed more or less strongly against flat surface 303 so that convex shoulder 357 at transverse slots 341 is adjusted to be respectively less or more rounded so that smooth sliding and quick and easy insertion of first parallel print edge 331 into proximate portion 315 of internal slot 314 is facilitated.

In the organizing mode of operation indicated generally at 335, first parallel mounting strips 332 are arrayed in parallel to second parallel mounting strips 384 on flat surface 303 by inserting transverse arms 349 into parallel transverse slots 341 so that internal slots 314 open in the same direction and so that the distance 329 between transverse arms 349 is equal to the distance 330 between parallel print edges 331 and 333.

First parallel print edge 331 is then slid along surface 303, inserted into internal slot opening 317 and pushed through distal portion 316 over smoothly rounded convex surface 358 and fully into proximate portion 315 of internal slot 314 of first parallel mounting strip 332.

With the distance 329 between transverse arms 349 of parallel mounting strips 332 and 834 equal to the distance 330 between parallel print edges 331 and 333, and with the depth 324 of proximate portion 315 of internal slot 314 equal to the depth 326 of external slot 318, second parallel print edge 333 lies parallel to and immediately outside opening 319 of external slot 318 of second parallel mounting strip 334.

With gap width 320 of internal slot 314 sufficient to receive and lightly clamp first parallel print edge 331 with print thickness 337, and with second parallel print edge 333 lying outside opening 319 of external slot 318, prints 304 are easily and quickly inserted into, retained in, slid along or removed from internal slot 314 so that efficient organizing of multiple prints in mounting device 301 is facilitated.

In the displaying mode of operation indicated generally at 336, second parallel print edge 333 is inserted fully into external slot 318 of second parallel mounting strip 334. With the distance 329 between transverse arms 349 of parallel mounting strips 332 and 334 equal to the distance 330 between parallel print edges 331 and 333, and with the depth 324 of proximate portion 315 of internal slot 314 equal to the depth 326 of external slot 318, first parallel print edge 331 lies parallel to and even with transverse arm 349 of first parallel mounting strip 332 so that when a second parallel edge 333 of any other print 304 is inserted into external slot 318 of first parallel mounting strip 332, minimum space is wasted between the first parallel print edge 331 of print 304 and the second parallel print edge 333 of any other print 304 inserted into external slot 318 of first parallel mounting strip 332 and the prints remain in full view.

With the distance 329 between transverse arms 349 of parallel mounting strips 332 and 384 equal to the distance 330 between parallel print edges 331 and 333, and with the depth 325 of distal portion 316 of internal slot 314 at least equal to the depth 326 of external slot 318, first parallel print edge 331 lies parallel to and even with demarcation line 323 of long leg 309 of first parallel mounting strip 332 so that first parallel print edge 331 is lightly clamped in distal portion 316 of internal slot 314 so that print 304 is held flat against flat surface 303 in internal slot 314 for optimum display of prints in the displaying mode.

With gap width 321 of external slot 318 sufficient to receive and firmly clamp second parallel print edge 333 with print thickness 337, print 304 is prevented from sliding in or falling out of said mounting means 305, irrespective of the orientation of mounting device 301.

Obviously, many other modifications and variations of the present invention are made possible in light of the above teachings. For example, the base may have attachment means in its back surface for fastening to a vertical wall; the base may have a flat surface front and back for mounting prints; the base may have a frame or molding around its perimeter; the attachment means may be in the form of a permanent adhesive bond or mechanical fastening; the attachment means may be in the form of a semi-permanent adhesive bond, mechanical fastening or velcro-type fastening; the thickness of the seam affecting the gap width of the external slot may be in the form of a raised portion of the flat surface; the seam may be continuous or interrupted; the transverse slots, floor, ceiling and serrations may individually or collectively be in the form of inserts set in the base; the transverse arms may have multiple fingers with corresponding serrations for reciprocally, adjustably, demountably and remountably retaining the mounting strips in the base; the transverse arms may be continuous or interrupted; the mounting strips may be continuous or interrupted, without departing from the scope of the invention. It is therefore to be understood that within the scope of the appended claims, the invention may be practiced otherwise than as specifically described.

I claim:

1. A mounting means for photographic prints, cards and similar graphic and/or alphanumeric display panels or sheets comprising:

(a) two or more mounting strips comprising a fold along the length of said mounting strips, said fold forming a lip, a long leg and a short leg;

(b) attachment means on said long leg, said attachment means having a bond with a seam running parallel to said length of said mounting strip and along said long leg, said attachment means for fastening said mounting strips to any flat surface;

(c) an internal slot bounded by said lip, said long leg and said short leg, said internal slot having an opening between said long leg and said short leg distal to said lip and a proximate portion proximate to said lip and a distal portion distal to said lip, said proximate and distal portions demarcated by said seam along said long leg;

(d) an external slot partially bounded by said seam, said long leg, and said lip, said external slot having an opening;

whereby a plurality of said mounting strips may be fastened parallel to each other on said flat surface with said internal slot openings oriented in the same direction;

whereby said internal slot has a gap width between said short leg and said long leg sufficient to receive and to lightly clamp the edges of said prints;

whereby said external slot has a gap width sufficient to receive and to firmly clamp the edges of said prints;

whereby said seam forms the demarcation between said proximate and said distal portions of said internal slots;

whereby the depth of said proximate portion of said internal slot and the depth of said external slot of said mounting strips are substantially equal to each other;

whereby the depth of said distal portion of said internal slot is at least equal to the depth of said external slot;

whereby, the distance between said seams is adapted to be substantially equal to the distance between two parallel edges of the print to be mounted so that when the first parallel edge of said print is inserted fully into said proximate portion of said internal slot of a first parallel mounting strip, the second parallel edge of said print lies parallel to and outside of said external slot opening of a second parallel mounting strip so that said light clamping of said first parallel edge of said print in said internal slot of the first parallel mounting strip may allow said print to be freely moved along said internal slot;

whereby, when said second parallel edge of said print is then pushed fully into said external slot of the second parallel mounting strip to as far as said seam between said flat surface and said long leg, said first parallel edge of said print remains inside said distal portion of said internal slot of said first mounting strip so that said print may be held flat against said surface;

whereby, when said second parallel edge of said print is then pushed fully into said external slot of the second parallel mounting strip to as far as said seam between said flat surface and said long leg, said first parallel edge of said print remains inside said distal portion of said internal slot of said first mounting strip and said firm clamping of said second parallel edge of said print in said external slot of the second parallel mounting strip may allow said print to be retained in said external slot and may prevent said print from sliding or falling out, irrespective of the orientation of said mounting means;

whereby, when said second parallel edge of said print is pushed fully into said external slot of the second parallel mounting strip to as far as said seam between said flat surface and said long leg, said first parallel edge of said print remains parallel to and even with said seam at the demarcation between said proximate and distal portions of said internal slot so that minimum space may be wasted between said first parallel edge of said print in said distal portion of said internal slot of said mounting strip and said second parallel edge of any other print inserted into said external slot of the same mounting strip.

2. The mounting means of claim 1 wherein said mounting strips are resiliently flexible whereby, when said first parallel edge of said print is inserted into said internal slot, said gap width of said internal slot may be adjustably increased or decreased so that various thicknesses of said edges of said prints may be received by and lightly clamped in said internal slot;

whereby said first parallel edge of said print lightly clamped in said distal portion of said internal slot may allow said print to be held flat against said flat surface;

whereby, when said second parallel edge of said print is inserted into said external slot, said gap width of said external slot may be adjustably increased or decreased so that various thicknesses of said edges of said prints may be received by and firmly clamped in said external slot;

whereby said second parallel edge of said print firmly clamped in said external slot may prevent said print from sliding or falling out, irrespective of the orientation of said mounting means;

whereby, when said prints are removed from said mounting means, said light clamping of said first parallel edge of said print in said distal portion of said internal slot may facilitate withdrawal of said first parallel edge from said distal portion of said internal slot so that said firmly clamped second parallel print edge then may be easily pulled out of said external slot, so that quick and easy removal of prints from said mounting means may be facilitated.

3. The mounting means of claim 1 wherein said seam is adapted to have a thickness proportional to the thickness of said print edges whereby said thickness may be sufficient to form a gap between said flat surface and said long leg of said mounting strips so that said second parallel print edge may be received by said external slot and firmly clamped between said flat surface and said long leg of said external slot.

4. The mounting means of claim 1 wherein said attachment means is permanent whereby prints having the distance between said first and second parallel print edges substantially equal to the distance between said parallel seams may be received and clamped by said mounting means.

5. The mounting means of claim 1 wherein said attachment means is semi-permanent whereby said mounting strips may be demountably fastened to any flat surface;

whereby said mounting strips may be adjustably arrayed in parallel to each other on any flat surface;

whereby the distance between said parallel mounting strips may be adjustably increased or decreased so that said mounting means may receive and clamp said first and second parallel edges of prints of various sizes and orientations.

6. The mounting means of claim 1 wherein said long leg of said mounting strips is longer than said short leg whereby, when a print is mounted, said first parallel edge may first slide along said long leg so that quick and easy insertion of said first parallel print edge into said internal slot opening and said distal portion of said internal slot may be facilitated.

7. The mounting means of claim 1 wherein said lip is convex whereby, when said second parallel edge of said print is inserted into said external slot opening, said lip may smoothly deflect said second parallel edge of said print into said external slot opening so that quick and easy insertion of said second parallel print edge into said external slot may be facilitated.

8. The mounting means of claim 1 wherein the depth of said proximate portion of said internal slot, the depth of said distal portion of said internal slot and the depth of said external slot of said mounting strips are substantially equal to each other whereby, when said first parallel print edge is lightly clamped in said distal portion of said internal slot and said second parallel print edge is firmly clamped in said external slot, the width of said first parallel print edge clamped in said internal slot is equal to the width of said second parallel print edge clamped in said external slot.

9. The mounting means of claim 1 wherein the length of said mounting strips is adapted to be at least equal to the total distance between the unclamped edges of a plurality of said prints mounted in said mounting strips whereby, when said prints are mounted in said mounting strips, said unclamped edges may lie immediately adjacent to each other so that minimum space may be wasted between said adjacent edges of said prints and said prints may remain in full view.

10. The mounting means of claim 1 wherein said mounting strips are transparent whereby, when said first parallel print edge is clamped in said distal portion of said internal slots and said second parallel print edge is clamped in said external slots of said mounting strips, said first parallel edge may be visible through said transparent short leg and said second parallel edge may be visible through said transparent short and long legs so that said prints may remain in full view.

11. A mounting means for photographic prints, cards and similar graphic and/or alphanumeric display panels or sheets comprising:

(a) a base for mounting and displaying prints, said base having a flat surface;

(b) two or more mounting strips comprising:
a fold along the length of said mounting strips, said fold forming a lip, a long leg and a short leg;

(c) attachment means between said long leg and said flat surface, said attachment means having a bond with a seam running parallel to said length of said mounting strip and along said long leg, said attachment means for fastening said mounting strips to said flat surface;

(d) an internal slot bounded by said lip, said long leg and said short leg, said internal slot having an opening between said long leg and said short leg distal to said lip and a proximate portion proximate to said lip and a distal portion distal to said lip, said proximate and distal portions demarcated by said seam along said long leg;

(e) an external slot bounded by said seam, said flat surface, said long leg and said lip, said external slot having an opening between said flat surface and said lip distal to said seam;

whereby a plurality of said mounting strips may be fastened parallel to each other on said flat surface with said internal slot openings oriented in the same direction;

whereby said internal slot has a gap width between said short leg and said long leg sufficient for receiving and lightly clamping the edges of said prints;

whereby said external slot has a gap width between said flat surface and said long leg sufficient for receiving and firmly clamping the edges of said prints;

whereby said seam between said long leg and said flat surface forms the demarcation between said proximate and said distal portions of said internal slots;

whereby the depth of said proximate portion of said internal slot and the depth of said external slot of said mounting strips are substantially equal to each other;

whereby the depth of said distal portion of said internal slot is at least equal to the depth of said external slot;

whereby, the distance between said seams is adapted to be substantially equal to the distance between two parallel edges of the print to be mounted so that when the first parallel edge of said print is inserted fully into said proximate portion of said internal slot of a first parallel mounting strip, the second parallel edge of said print lies parallel to and outside of said external slot opening of a second parallel mounting strip so that said light clamping of said first parallel edge of said print in said internal slot of the first parallel mounting strip may allow said print to be freely moved along said internal slot;

whereby, when said second parallel edge of said print is then pushed fully into said external slot of the second parallel mounting strip to as far as said seam between said flat surface and said long leg, said first parallel edge of said print remains inside said distal portion of said internal slot of said first mounting strip so that said print may be held flat against said surface;

whereby, when said second parallel edge of said print is then pushed fully into said external slot of the second parallel mounting strip to as far as said seam between said flat surface and said long leg, said first parallel edge of said print remains inside said distal portion of said internal slot of said first mounting strip and said firm clamping of said second parallel edge of said print in said external slot of the second parallel mounting strip may allow said print to be retained in said external slot and may prevent said print from sliding or falling out, irrespective of the orientation of said mounting means;

whereby, when said second parallel edge of said print is pushed fully into said external slot of the second parallel mounting strip to as far as said seam between said flat surface and said long leg, said first parallel edge of said print remains parallel to and even with said seam at the demarcation between said proximate and distal portions of said internal slot so that minimum space may be wasted between said first parallel edge of said print in said distal portion of said internal slot of said mounting strip and said second parallel edge of any other print inserted into said external slot of the same mounting strip;

whereby, when said prints are removed from said mounting means, said light clamping of said first parallel edge of said print in said distal portion of said internal slot may facilitate withdrawal of said first parallel edge from said distal portion of said internal slot so that said firmly clamped second parallel print edge then may be easily pulled out of said external slot, so that quick and easy removal of prints from said mounting means may be facilitated.

12. The mounting means of claim 11 wherein said mounting strips are resiliently flexible whereby, when said first parallel edge of said print is inserted into said internal slot, said gap width of said internal slot may be adjustably increased or decreased so that various thicknesses of said edges of said prints may be received by and lightly clamped in said internal slot;

whereby said first parallel edge of said print lightly clamped in said distal portion of said internal slot may allow said print to be held flat against said flat surface;

whereby, when said second parallel edge of said print is inserted into said external slot, said gap width of said external slot may be adjustably increased or decreased so that various thicknesses of said edges of said prints may be received by and firmly clamped in said external slot;

whereby said second parallel edge of said print firmly clamped in said external slot may prevent said print from sliding or falling out, irrespective of the orientation of said mounting means;

whereby, when said prints are removed from said mounting means, said light clamping of said first parallel edge of said print in said distal portion of said internal slot may facilitate withdrawal of said first parallel edge from said distal portion of said internal slot so that said firmly clamped second parallel print edge then may be easily pulled out of said external slot, so that quick and easy removal of prints from said mounting means may be facilitated.

13. The mounting means of claim 11 wherein said seam is adapted to have a thickness proportional to the thickness of said print edges whereby said thickness may be sufficient to form a gap between said flat surface and said long leg of said mounting strips so that said second parallel print edge may be received by said external slot and firmly clamped between said flat surface and said long leg of said external slot.

14. The mounting means of claim 11 wherein said attachment means between said flat surface and said long leg is permanent whereby prints having the distance between said first and second parallel print edges substantially equal to the distance between said parallel seams may be received and clamped by said mounting means.

15. The mounting means of claim 11 wherein said attachment means between said flat surface and said long leg is semi-permanent whereby said mounting strips may be demountably fastened to said flat surface;

whereby said mounting strips may be adjustably arrayed in parallel to each other on said flat surface;

whereby the distance between said parallel mounting strips may be adjustably increased or decreased so that said mounting means may receive and clamp said first and second parallel edges of prints of various sizes and orientations.

16. The mounting means of claim 11 wherein said long leg of said mounting strips is longer than said short leg whereby, when a print is mounted, said first parallel edge may first slide along said long leg so that quick and easy insertion of said first parallel print edge into said internal slot opening and said distal portion of said internal slot may be facilitated.

17. The mounting means of claim 11 wherein said lip is convex whereby, when said second parallel edge of said print is inserted into said external slot opening, said lip may smoothly deflect said second parallel edge of said print into said external slot opening so that quick and easy insertion of said second parallel print edge into said external slot may be facilitated.

18. The mounting means of claim 11 wherein the depth of said proximate portion of said internal slot, the depth of said distal portion of said internal slot and the depth of said external slot of said mounting strips are substantially equal to each other whereby, when said first parallel print edge is lightly clamped in said distal portion of said internal slot and said second parallel print edge is firmly clamped in said external slot, the width of said first parallel print edge clamped in said internal slot is equal to the width of said second parallel print edge clamped in said external slot.

19. The mounting means of claim 11 wherein the length of said mounting strips is adapted to be at least equal to the total distance between the unclamped edges of a plurality of said prints mounted in said mounting strips whereby, when said print s are mounted in said mounting strips, said unclamped edges may lie immediately adjacent to each other so that minimum space may be wasted between said adjacent edges of said prints and said prints may remain in full view.

20. The mounting means of claim 11 wherein said mounting strips are transparent whereby, when said first parallel print edge is clamped in said distal portion of said internal slots and said second parallel print edge is clamped in said external slots of said mounting strips, said first parallel edge may be visible through said transparent short leg and said second parallel edge may be visible through said transparent short and long legs so that said prints may remain in full view.

* * * * *